United States Patent [19]

Wiesner et al.

[11] 4,397,611

[45] Aug. 9, 1983

[54] PARTICLE BEAM INSTRUMENTATION ION PUMP

[75] Inventors: John C. Wiesner, Hayward; Lee H. Veneklasen, Castro Valley, both of Calif.

[73] Assignee: The Perkin-Elmer Corp., Norwalk, Conn.

[21] Appl. No.: 280,414

[22] Filed: Jul. 6, 1981

[51] Int. Cl.[3] ..... F04B 37/02

[52] U.S. Cl. ..... 417/49; 328/233

[58] Field of Search ..... 417/48, 49; 313/7; 328/233, 235

[56] References Cited

U.S. PATENT DOCUMENTS

| | | | |
|---|---|---|---|
| 3,299,311 | 1/1967 | Veith et al. | 313/7 X |
| 3,379,365 | 4/1968 | Hait | 417/49 |
| 3,463,959 | 8/1969 | Jory et al. | 328/233 X |
| 3,596,123 | 7/1971 | Levin | 417/49 X |

*Primary Examiner*—Edward K. Look

*Attorney, Agent, or Firm*—S. A. Giarratana; T. P. Murphy; J. R. Dwyer

[57] ABSTRACT

In particle beam optical instrumentation, an array of conventional sputter ion pump cells distributed in a ring shaped array about the circumference of the volume (optical column) to be pumped. An axially symmetrical, hollow, toroid magnetic circuit, formed by axially symmetrical magnets, either of the permanent type or of the electromagnetic type (or a combination of both), is used and the pumping action is outward from the central throughbore in the column so that the bore space could be occupied by other instrumentation. The magnetic circit may be used for particle beam focusing (optical lens) as well as for the pumping action by introducing magnetic gaps in either a series or parallel configuration.

6 Claims, 5 Drawing Figures

PARTICLE BEAM INSTRUMENTATION ION PUMP

BACKGROUND OF THE INVENTION

This invention relates in general to sputter ion pumps and is particularly directed to a new and improved sputter ion pump for particle beam optical instrumentation. Sputter ion pumps are old and well known as typically shown and their operation explained, for example, in the U.S. Patent to Jepsen, No. 3,094,639, the U.S. Patent to Lloyd, et al., No. 3,042,824, or as described in an earlier U.S. Patent to Hall, et al., No. 2,993,638.

The pump cells (anode and cathode) of these sputter ion pumps are the building blocks of an ion pump and are usually placed in a vacuum chamber and packaged in self-contained units with flanges. The units are then typically connected, as an appendage, to a chamber, pipe, or optical column. As an appendage, however, the ion pump, being magnetic, tended to distort the operation of the particle beam in the optical column and also required the optical column and thus the beam path to be longer than desired. Thus, in the particle beam application, if the magnetic circuit and pumping cell distribution are suitably arranged, other instrumentation, such as valves, apertures, etc., could be used without additional bore length. This would result in a compact highly integrated structure. Also, if appropriately arranged, not only can the residual magnetic fields be minimized and a compact structure attained, but according to the teachings of this invention the magnetic field of the ion pump can be utilized for particle beam focusing.

SUMMARY OF THE INVENTION

The invention which teaches the foregoing desired arrangement in the art of particle beam optical instrumentation comprises an array of conventional sputter ion pump cells distributed in a ring shaped array about the circumference of the volume (optical column) to be pumped. An axially symmetrical, hollow, toroid magnetic circuit, formed by axially symmetrical magnets, either of the permanent type or of the electromagnetic type (or a combination of both), is used and the pumping action is outward from the central throughbore in the column so that the bore space could be occupied by other instrumentation. The magnetic circuit may be used for particle beam focusing (optical lens) as well as for the pumping action by introducing magnetic gaps in either a series or parallel configuration.

DETAILED DESCRIPTION

Figure 1:
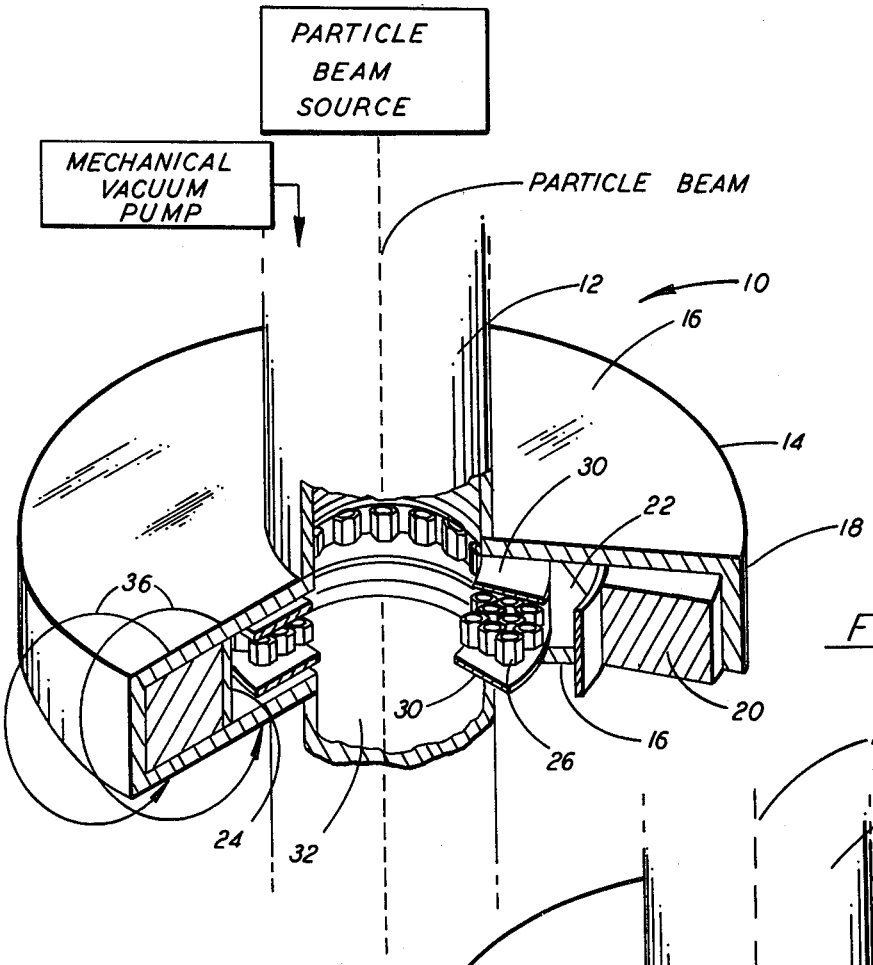
FIG. 1 is a perspective view, partially broken away, of a sputter ion pump constructed in accordance with the teachings of this invention as a pump and optical lens combination operating in a parallel configuration.
Figure 1A:
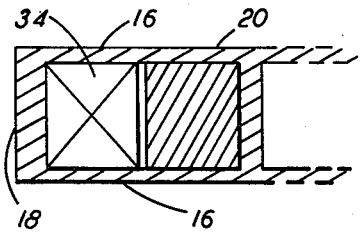
FIG. 1A illustrates the combination of an electromagnet and permanent magnet.

Turning now to FIG. 1 which shows the ion pump and optical column combination 10 in a parallel configuration. The optical column is indicated by the reference number 12 and shown surounded by a hollow, toroidal ring pump housing 14 with top and bottom walls 16 and side wall 18. The housing contains a solid toroidal permanent magnet 20 sealed from the pumping chamber 22 by a seal plate in the form of a ring or band 24. The pump cell in this embodiment comprises a plurality of relatively short cylindrical anode cells 26 grouped in a toroidal ring configuration and spaced from a pair of cathode plates 30. The pump chamber 22 is open to the center, or main vacuum chamber 32, of the optical column 12 and the vacuum source for the main chamber 32 optical column also is the source for the initial vacuum on the ion pump chamber 22. As taught by the aforesaid patents, as the appropriate vacuum under the influence of the magnetic field, and with the appropriate potentials applied to the anode and cathodes, a discharge is formed within the individual cells for the pumping action to take place. Since the operation of the ion pump is conventional no further description is deemed necessary herein. What is new is this configuration is the fact that the ion pump is of a coaxial toroidal configuration and is a combination of a pump and magnetic lens with the pump chamber opening into the main chamber as shown. In this embodiment the optic lens is fixed in that the strength of the magnetic field cannot be varied. It is understood, however, that not only can be permanent magnet be replaced by an electromagnet but that the magnets can be combined, i.e., a permanent magnet and an electromagnet, such as 34, with the electromagnet acting as trim coil to control the strength of the magnetic field in the pump as shown in FIG. 1A. This arrangement in either FIG. 1 or 1A is called a parallel configuration by reason of the manner in which the magnetic field cooperates with the elements as shown by the arrows 36.

Figure 2:
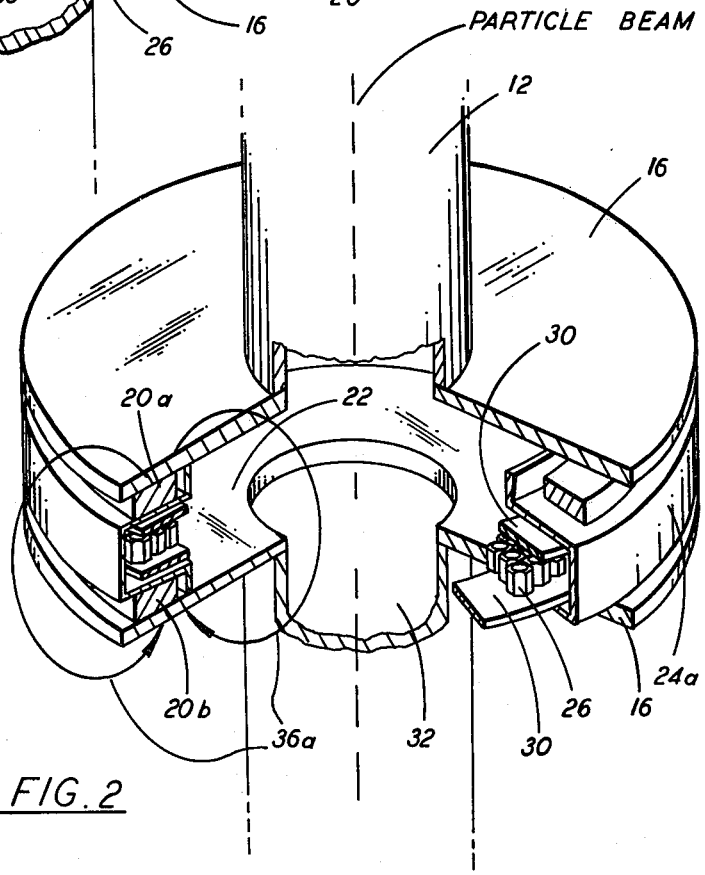
FIG. 2 is a view similar to FIG. 1 except that the pump and lens combination is in a series configuration.
Figure 3:
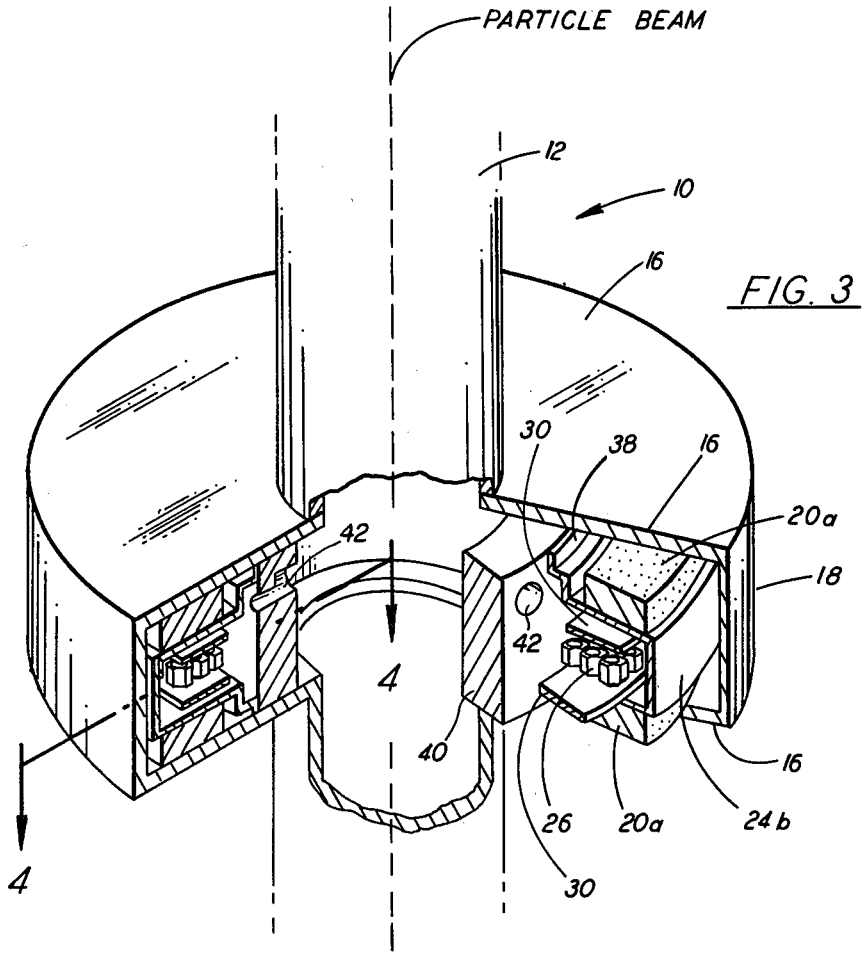
FIG. 3 shows a view similar to FIGS. 1 and 2 except that the magnetic gap is shunted thereby eliminating the lens aspect of the invention.
Figure 4:
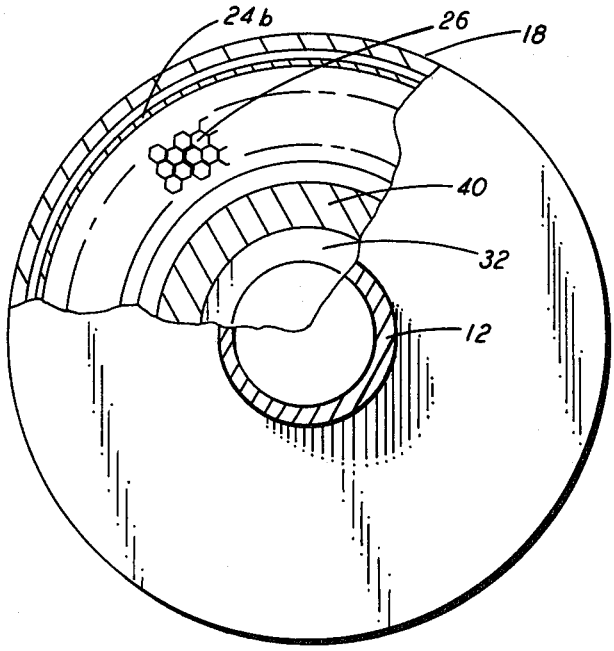
FIG. 4 is a plane view of a broken away portion as indicated by line 4—4 of FIG. 3.

In FIG. 2, the ion pump opens into the center of the optical column, except that in this case, the side wall 18 of the housing has been eliminated and the permanent magnet 7 comprises relatively thick magnetic rings **20*a* and 20*b* with the pumping cell 30 located therebetween. To seal the magnets from the pumping cell, a seal plate 24*a* is disposed between the magnets and the pumping cell. In order to bring the pumping cell directly in line with the mgnetic field, however, the seal plate 24*a* is formed essentially hat shaped in crossection to encompass the pumping cell. Again, the pump chamber 22 opens into the column base 32. This configuration is called a series lens combination because of the manner in which the magnetic field is distributed in the pump as illustrated by the arrows 36*a*. The pumping action of the pump cell, under the influence of the magnetic field, is the same as that described in connection with FIG. 1. In the embodiment, there may be control of the magnetic field of the pump as by a trim coil such as in FIG. 1A, in the effect of the magnetic field is essentially a permanent but somewhat variable lens. The trim coil, if used in this embodiment, would be in two parts each located on the radially outer side of the two magnetic rings 20*a* and 20*b*. It should be apparent that in FIG. 2 the components that are exactly like those of FIG. 1 were given the same reference number but those whose function were the same as in FIG. 1 but are of a different configuration are given the same reference number but with a suffix a to denote the different configuration. This same concept is applied to FIGS. 3 and 4 except the suffix b is used. In FIG. 3, the pump housing is essentially the same as the housing in FIG. 1 and the magnets and pumping cell are essentially the same as in FIG. 2 but the seal plate 24***b* is modified by the addition of flange 38 to engage to magnetic shunt plate 40 which short circuits the magnetic field so that the latter will have little or no effect on the particle beam within the optical column. However, for the ion pumping action, the magnetic shunt plate 40 is apertured as at 42 so as to be open to the throughbore facilitating evacuation of the pumping chamber. It should be apparent that the magnetic shunt plate 40 while shown in connection with the pumping cell configuration of FIG. 2 may also be used in the pumping cell configuration of FIG. 1. In summary, there is disclosed an ion pump preferably for particle beam instrumentation which is toroidal in configuration and provides a symmetrical magnetic field for the optical column thus reducing the adverse effects of the prior art pumps on the particle beam. By this configuration the optical column and pump combination is shortened and the magnetic field for the ion pump may be used for particle beam focusing.

What is claimed is:

1. In a column configuration with a throughbore through which a particle beam may be directed as part of a particle beam optical instrument and subject to evacuation by an ion pump, said ion pump having a pumping cell means and magnetic means within a housing which defines a pumping chamber opening into said throughbore, the improvement in the combination of the column for the particle beam optical instrument and ion pump wherein, said housing and said pumping chamber are substantially toroidal in configuration, said pumping cell means comprises in part a plurality of honeycomb cell means of toroidal configuration, cathode plate means for said honeycomb cell means spaced apart therefrom and conforming to the toroidal configuration of said honeycomb cell means, said honeycomb cell means and cathode plate means completing said pumping cell means, and magnetic means within said housing and toroidal in configuration for providing a toroidal symmetrical, magnetic circuit with said housing thus defining an ion pump in combination with said column.

2. The improvement as claimed in claim 1 wherein said magnetic means is of the permanent magnet type completely enclosed within said housing.

3. The improvement as claimed in claim 2 wherein said magnetic means further includes a trimmer coil for varying the magnetic field in said pump chamber.

4. The improvement as claimed in claim 1 wherein said magnetic means comprises a pair of spaced apart rings and wherein said pumping cell means is located between rings.

5. The improvement as claimed in claim 1 wherein the column forms part of the instrumentation for the particle beam instrument and the magnetic means together with said housing form a lens means for influencing the particle beam within said throughbore.

6. The improvement as claimed in claim 1 further including a magnetic shunt between said pumping chamber and said throughbore and means communicating said throughbore with said pumping chamber through said magnetic shunt.

* * * * *

UNITED STATES PATENT AND TRADEMARK OFFICE

CERTIFICATE OF CORRECTION

PATENT NO. : 4,397,611

DATED : Aug. 9, 1983

INVENTOR(S) : John C. Wiesner and Lee H. Veneklasen

It is certified that error appears in the above-identified patent and that said Letters Patent are hereby corrected as shown below:

Column 2, line 6, change "surounded" to --surrounded--, line 25, change "is", third occurrence to -- in --.

line 32, change "be" to --the-- line 49, change "mgnetic" to -- magnetic --.

In the ABSTRACT:

line 12, change "circit" to --circuit--.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*